United States Patent [19]

Vohl

[11] 4,188,738

[45] Feb. 19, 1980

[54] ENDLESS SCREW PROPELLER UNIT FOR A SNOW THROWER

[76] Inventor: Paul-Eugéne Vohl, 1738 Principale St., St. Marc des Carrieres, Canada

[21] Appl. No.: 922,073

[22] Filed: Jul. 5, 1978

[51] Int. Cl.[2] ..... E01H 5/09

[52] U.S. Cl. ..... 37/43 E; 172/119; 56/294

[58] Field of Search ..... 37/43 R, 43 C, 43 E, 37/53, 81; 172/119, 532; 198/676; 299/87; 56/294

[56] References Cited

U.S. PATENT DOCUMENTS

| | | | |
|---|---|---|---|
| 1,103,242 | 7/1914 | Akins | 172/119 X |
| 1,790,789 | 2/1931 | Bosworth | 37/43 E X |
| 2,309,418 | 1/1943 | Schweickart et al. | 198/676 X |
| 2,597,052 | 5/1952 | Barker | 37/43 E |
| 3,073,100 | 1/1963 | Kingsley | 37/43 E X |
| 3,295,232 | 1/1967 | Oglesby et al. | 37/43 R |
| 3,862,539 | 1/1975 | Stevens | 56/294 X |
| 3,913,247 | 10/1975 | Ruhl | 37/43 E |
| 4,139,318 | 2/1979 | Jacob et al. | 37/43 E X |

FOREIGN PATENT DOCUMENTS

| | | | |
|---|---|---|---|
| 69152 | 6/1915 | Austria | 37/81 |
| 69263 | 7/1915 | Austria | 198/676 |
| 477161 | 9/1951 | Canada | 37/43 E |
| 272819 | 4/1914 | Fed. Rep. of Germany | 172/532 |
| 325263 | 9/1919 | Fed. Rep. of Germany | 172/532 |
| 1224143 | 6/1960 | France | 37/81 |

*Primary Examiner*—E. H. Eickholt

[57] ABSTRACT

A snow thrower machine and in particular an associated endless screw propeller unit which is adapted to strike or bite an encountered layer or crust of ice to break it into pieces of blowable sizes. This endless screw propeller unit includes an helicoidal blade wound around a transverse axis and having a limited number of teeth circumferentially spaced along the outer edge of the blade. The latter has outer edge portions radially diminishing toward and up to the teeth respectively, and leading the latter relative to the direction of rotation of the propeller blade whereby the leading edge of each tooth is adapted to strike and bite the ice to break it into pieces. The teeth do not protrude from the outer peripheral edge and from the leading face of the blade so as not to damage road pavement and not to impede the axial flow of snow and ice pieces towards the impeller of the machine.

1 Claim, 6 Drawing Figures

ENDLESS SCREW PROPELLER UNIT FOR A SNOW THROWER

This invention relates to a snow thrower machine, and more particularly, to a screw propeller unit for a snow thrower machine.

The snow thrower machines which have been proposed so far in many icy conditions are unable to remove a layer or crust of ice since the corresponding endless screw propeller unit is unable to firmly attack the ice to break it and blow it away. The problem with the anteriorly conceived machine is apparently due to the fact that the helicoidal blade or blades of the corresponding endless screw propeller units pushes the ice away instead of biting into it or breaking it into blowable sizes.

It is a general object of the present invention to provide a snow thrower machine and associated screw propeller unit which are able to remove a layer or crust of ice in about any icy condition.

It is a more specific object of the present invention to provide a snow thrower machine wherein the snow propeller blade is able to bite into and break substantially any crust or layer of ice into pieces of blowable sizes.

It is a specific object of the present invention to provide a snow thrower machine wherein the snow propeller blade is provided with teeth and with radially indented portions allowing the teeth to strike or bite the layer or crust of ice to break it into pieces of blowable sizes.

The above and other objects and advantages of the present invention will be better understood with reference to the following detailed description of a preferred embodiment thereof which is illustrated, by way of example, in the accompanying drawing; in which.

Figure 1:
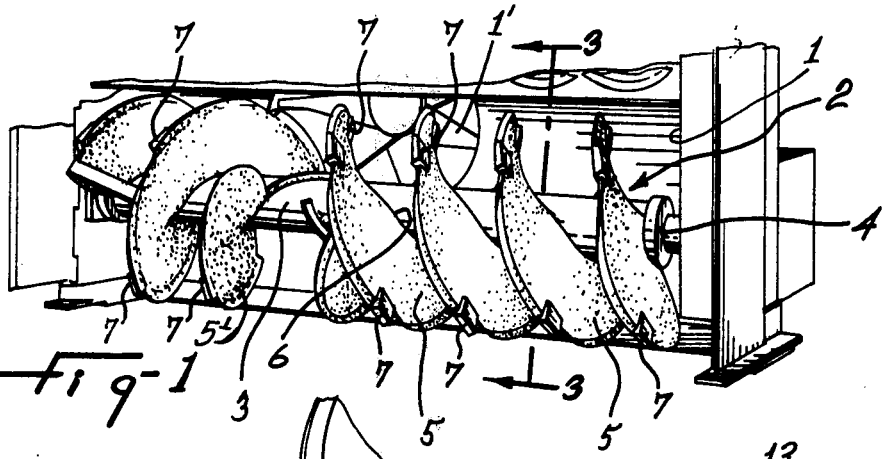
FIG. 1 is a front view of a portion of a snow thrower machine and an endless screw propeller unit thereof according to the present invention.
Figure 2:
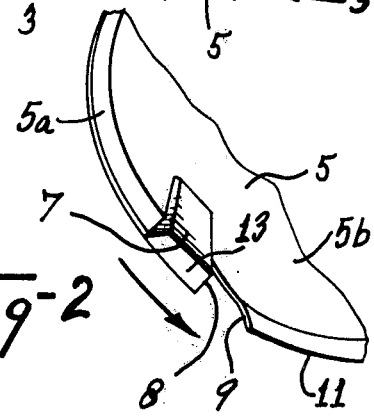
FIG. 2 is a perspective partial view of one revolution of the endless screw propeller unit of FIG. 1.
Figure 3:
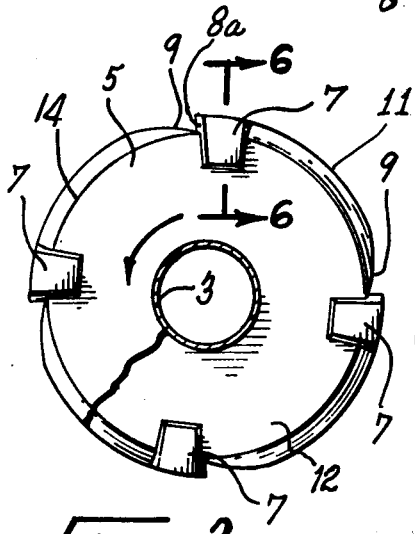
Figure 4:
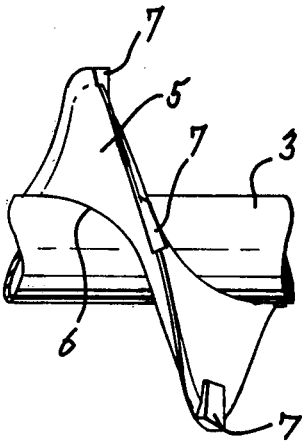
Figure 5:
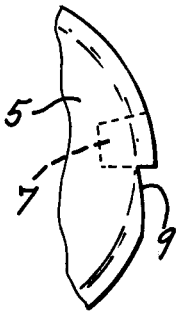

FIG. 3 a cross-sectional view as seen along line 3—3, in FIG. 1;

FIG. 4 is an enlarged radial view of one revolution of the endless screw propeller unit; and FIG. 5 is a partial view of one revolution as seen from the right in FIG. 4.

Figure 6:
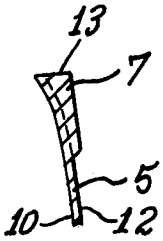

FIG. 6 is a cross sectional detail of the teeth 7 of FIG. 5.

The snow thrower machine illustrated in FIG. 1 includes a pair of superposed screw propeller units longitudinally mounted transversely in the mouth 1 of the machine. Only part of the top screw propeller unit is shown in FIG. 1 since the details thereof do not form part of the present invention. The present invention is directed to the bottom screw propeller unit 2.

The illustrated endless screw propeller unit 2 includes a central tube 3 forming the hub of the unit and rotatably mounted at each end by a bearing 4, as shown on the right in FIG. 1. The screw propeller unit 2 also includes an helicoidal propeller blade 5 which is wound around the central tube 3 and rigidly welded thereto along its inner edge, at 6. The helicoidal blade 5 is wound in appropriate direction to propel the snow toward the center of the snow thrower. The complete screw propeller unit 2 includes the helicoidal blade 5 and another helicoidal blade 5', which is wound in opposite direction around the tube 3 such that both propeller blades propel the snow and pieces of ice toward the center of the machine from where it is blown away by an impeller 1' mounted rearward of the unit, as is well known in the art. Each blade 5 or 5' has an outer marginal portion **5*a* which is inclined at an obtuse angle relative to the main portion 5*b* of the blade and projects from the leading face 10 of blade 5 or 5' relative to the axial propelling direction of the latter. The outer peripheral edge 11 of blade 5 or 5' is substantially radially equally distant for the most part from the rotational axis of hub 3. Each blade 5 or 5' includes a predetermined or limited number of teeth 7 substantially equally spaced along the peripheral edge of blade 5 or 5'. For instance, as shown in FIG. 1, the helicoidal blade 5 propels the snow and ice pieces toward the left and the teeth 7 are fixed against the right face of the blade. Each tooth 7 has an upstream face 8*a* and a sharp upstream edge 8 relative to the direction of rotation of blade 5 or 5' operatively inducing the ice to break upon rotary impact with ice. The radially outer face 13 of teeth 7 is flush with the outer edge 11 and there are no protrusions at the leading face 10 of the blade 5 or 5' opposite tooth 7**.

The outer peripheral edge of helicoidal propeller blade 5 has outer edge portions 9 which radially diminish toward and up to the teeth 7 respectively causing the outer radial end of each tooth to radially project outward relative to the adjoining end of the associated outer edge portion. Each outer edge portion 9 is positioned on the upstream side of the corresponding tooth 7 relative to the direction of rotation of the helicoidal propeller blade. The upstream end of each portion 9 merges with the full radius outer edge 11, while the downstream end merges with the junction 14 of blade marginal portion **5*a* with blade main portion 5*b***.

Thus, upon rotation of the endless screw propeller unit 2, the ice crust or layer is engaged and struck by the edge 8 of the teeth 7 and the fully exposed upstream face **8*a* of said teeth, and is broken under the impact. The outer end portions 9 allows the teeth 7 to effectively so engage and strike the ice layer or crust. Since teeth 7 do not project beyond peripheral outer edge 11, they cannot damage a road paving when blade 5 and 5' operate close to or even in contact with said paving. Since teeth 7 form no protuberance at the leading face of blade 5 and 5', they do not impede the axial flow of the snow and pieces of ice toward the impeller 1'**.

What I claim is:

1. A snowblower screw comprising a shaft-like hub journalled in a casing for rotation about its longitudinal axis, a helicoidal blade surrounding and fixed to said hub at its inner peripheral edge, said blade having an outer peripheral edge substantially equally radially distant for the most part from the rotational axis of said hub, said blade having a leading face and an opposite trailing face relative to the direction in which the snow and ice engaged by said leading face move axially of said hub, said blade defining a radially inward main portion and a radially outer marginal portion adjacent to said outer peripheral edge, said outer marginal portion forming an obtuse angle with the main portion of said blade and projecting from said leading face, a plurality of rectangular shape hammer head-like blocks secured to said blade and substantially equally spaced around said blade, each block protruding from the trailing face of said blade but forming no protuberance at the leading face of said blade, each block having a radially outer face substantially flush with the outer peripheral edge of said blade, and an upstream face relative to the direction of rotation of said hub which is thicker than the thickness of said blade, said peripheral outer edge having edge portions, one for each block, which radially diminishes toward and up to the respective blocks, each outer edge portion having an upstream and merging with the full radius peripheral outer edge and a downstream end substantially coinciding with the junction of said inclined outer marginal portion with the main portion of said blade, each outer edge portion being disposed immediately upstream from the upstream face of the respective block, whereby said upstream face of the block is fully exposed substantially across its entire width, so that said upstream face may hit and break ice upon rotation of said screw, while said leading face of said blade presents a smooth surface devoid of any projection for engaging and pushing the snow and ice for movement axially of said hub, and while said radially outer face of said blocks forms a smooth continuation of the full radius outer peripheral edge of said blade to prevent damage to any road paving which said screw may contact.

* * * * *